US006374705B1

(12) United States Patent
Buchold

(10) Patent No.: US 6,374,705 B1
(45) Date of Patent: Apr. 23, 2002

(54) JAR OPENING DEVICE

(76) Inventor: Bonnie J. Buchold, 3701 N. Rawhide Cir., Castle Rock, CO (US) 80104

( * ) Notice: Subject to any disclaimer, the term of this patent is extended or adjusted under 35 U.S.C. 154(b) by 0 days.

(21) Appl. No.: 09/791,214

(22) Filed: Feb. 23, 2001

(51) Int. Cl.[7] ..... B67B 7/18
(52) U.S. Cl. ..... 81/3.25; 81/3.32
(58) Field of Search ..... 81/3.25, 3.32, 81/3.44, 3.43, 3.31, 3.2

(56) References Cited

U.S. PATENT DOCUMENTS

| | | | | | |
|---|---|---|---|---|---|
| 2,458,329 | A | | 1/1949 | Archer | |
| 3,048,068 | A | | 8/1962 | Griffiths | |
| 4,154,127 | A | | 5/1979 | Russo | |
| D268,164 | S | | 3/1983 | Sandberg | |
| 4,984,722 | A | | 1/1991 | Moore | |
| 5,203,236 | A | * | 4/1993 | Anderson | 81/3.2 |
| 5,325,991 | A | | 7/1994 | Williams | |
| 5,443,172 | A | | 8/1995 | Gabriele | |
| 6,125,718 | A | * | 10/2000 | Hill | 81/3.2 |
| 6,158,306 | A | * | 12/2000 | Gasparre | 81/3.32 |

* cited by examiner

*Primary Examiner*—Joseph J. Hail, III
*Assistant Examiner*—David B. Thomas

(57) ABSTRACT

A jar opening device for holding a jar, bottle or other container having a twist top in secured position for easy removing of the top. The jar opening device includes a generally vertical wall having a front surface and a back surface. The vertical wall has a first side edge, a second side edge, a top edge and a bottom edge. Each of a plurality of securing members extends through the vertical wall and into a counter wall for securing the vertical wall to the counter wall. A plate is integrally coupled to and extends outwardly from the front surface of the vertical wall. The plate is orientated generally horizontal and is positioned nearer the bottom edge than the top edge of the vertical wall. A first arm is elongated and has first end and second end. The first end of the first arm is pivotally coupled to the first side edge of the vertical wall and is movable in a horizontal plane. The first arm is positioned generally between the top edge and the plate. A first strap has a first end securely coupled to the second side edge and positioned generally between the top edge and the plate. A fastener removably fastens the first strap to the first arm.

11 Claims, 4 Drawing Sheets

JAR OPENING DEVICE

BACKGROUND OF THE INVENTION

1. Field of the Invention

The present invention relates to jar and bottle opening devices and more particularly pertains to a new jar opening device for holding a jar, bottle or other container having a twist top in secured position for easy removing of the top.

2. Description of the Prior Art

The use of jar and bottle opening devices is known in the prior art. More specifically, jar and bottle opening devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,984,722; 2,458,329; 3,048,068; 5,443,172; U.S. Des. Pat. No. 268,164; U.S. Pat. Nos. 4,154,127; and 5,325,991.

While these devices fulfill their respective, particular objectives and requirements, the aforementioned patents do not disclose a new jar opening device. The inventive device includes a generally vertical wall having a front surface and a back surface. The vertical wall has a first side edge, a second side edge, a top edge and a bottom edge. Each of a plurality of securing members extends through the vertical wall and into a counter wall for securing the vertical wall to the counter wall. A plate is integrally coupled to and extends outwardly from the front surface of the vertical wall. The plate is orientated generally horizontal and is positioned nearer the bottom edge than the top edge of the vertical wall. A first arm is elongated and has first end and second end. The first end of the first arm is pivotally coupled to the first side edge of the vertical wall and is movable in a horizontal plane. The first arm is positioned generally between the top edge and the plate. A first strap has a first end securely coupled to the second side edge and positioned generally between the top edge and the plate. A fastener removably fastens the first strap to the first arm.

In these respects, the jar opening device according to the present invention substantially departs from the conventional concepts and designs of the prior art, and in so doing provides an apparatus primarily developed for the purpose of holding a jar, bottle or other container having a twist top in secured position for easy removing of the top.

SUMMARY OF THE INVENTION

In view of the foregoing disadvantages inherent in the known types of jar and bottle opening devices now present in the prior art, the present invention provides a new jar opening device construction wherein the same can be utilized for holding a jar, bottle or other container having a twist top in secured position for easy removing of the top.

The general purpose of the present invention, which will be described subsequently in greater detail, is to provide a new jar opening device apparatus and method which has many of the advantages of the jar and bottle opening devices mentioned heretofore and many novel features that result in a new jar opening device which is not anticipated, rendered obvious, suggested, or even implied by any of the prior art jar and bottle opening devices, either alone or in any combination thereof.

To attain this, the present invention generally comprises a generally vertical wall having a front surface and a back surface. The vertical wall has a first side edge, a second side edge, a top edge and a bottom edge. Each of a plurality of securing members extends through the vertical wall and into a counter wall for securing the vertical wall to the counter wall. A plate is integrally coupled to and extends outwardly from the front surface of the vertical wall. The plate is orientated generally horizontal and is positioned nearer the bottom edge than the top edge of the vertical wall. A first arm is elongated and has first end and second end. The first end of the first arm is pivotally coupled to the first side edge of the vertical wall and is movable in a horizontal plane. The first arm is positioned generally between the top edge and the plate. A first strap has a first end securely coupled to the second side edge and positioned generally between the top edge and the plate. A fastener removably fastens the first strap to the first arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new jar opening device apparatus and method which has many of the advantages of the jar and bottle opening devices mentioned heretofore and many novel features that result in a new jar opening device which is not anticipated, rendered obvious, suggested, or even implied by any of the prior art jar and bottle opening devices, either alone or in any combination thereof.

It is another object of the present invention to provide a new jar opening device which may be easily and efficiently manufactured and marketed.

It is a further object of the present invention to provide a new jar opening device which is of a durable and reliable construction.

An even further object of the present invention is to provide a new jar opening device which is susceptible of a low cost of manufacture with regard to both materials and labor, and which accordingly is then susceptible of low prices of sale to the consuming public, thereby making such jar opening device economically available to the buying public.

Still yet another object of the present invention is to provide a new jar opening device which provides in the apparatuses and methods of the prior art some of the advantages thereof, while simultaneously overcoming some of the disadvantages normally associated therewith.

Still another object of the present invention is to provide a new jar opening device for holding a jar, bottle or other container having a twist top in secured position for easy removing of the top.

Yet another object of the present invention is to provide a new jar opening device which includes a generally vertical wall having a front surface and a back surface. The vertical wall has a first side edge, a second side edge, a top edge and a bottom edge. Each of a plurality of securing members extends through the vertical wall and into a counter wall for securing the vertical wall to the counter wall. A plate is integrally coupled to and extends outwardly from the front surface of the vertical wall. The plate is orientated generally horizontal and is positioned nearer the bottom edge than the top edge of the vertical wall. A first arm is elongated and has first end and second end. The first end of the first arm is pivotally coupled to the first side edge of the vertical wall and is movable in a horizontal plane. The first arm is positioned generally between the top edge and the plate. A first strap has a first end securely coupled to the second side edge and positioned generally between the top edge and the plate. A fastener removably fastens the first strap to the first arm.

Still yet another object of the present invention is to provide a new jar opening device that has adjustable arms for fitting variously sized bottles and jars.

Even still another object of the present invention is to provide a new jar opening device that arms having elastomeric coatings thereon for gripping the item to be opened.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
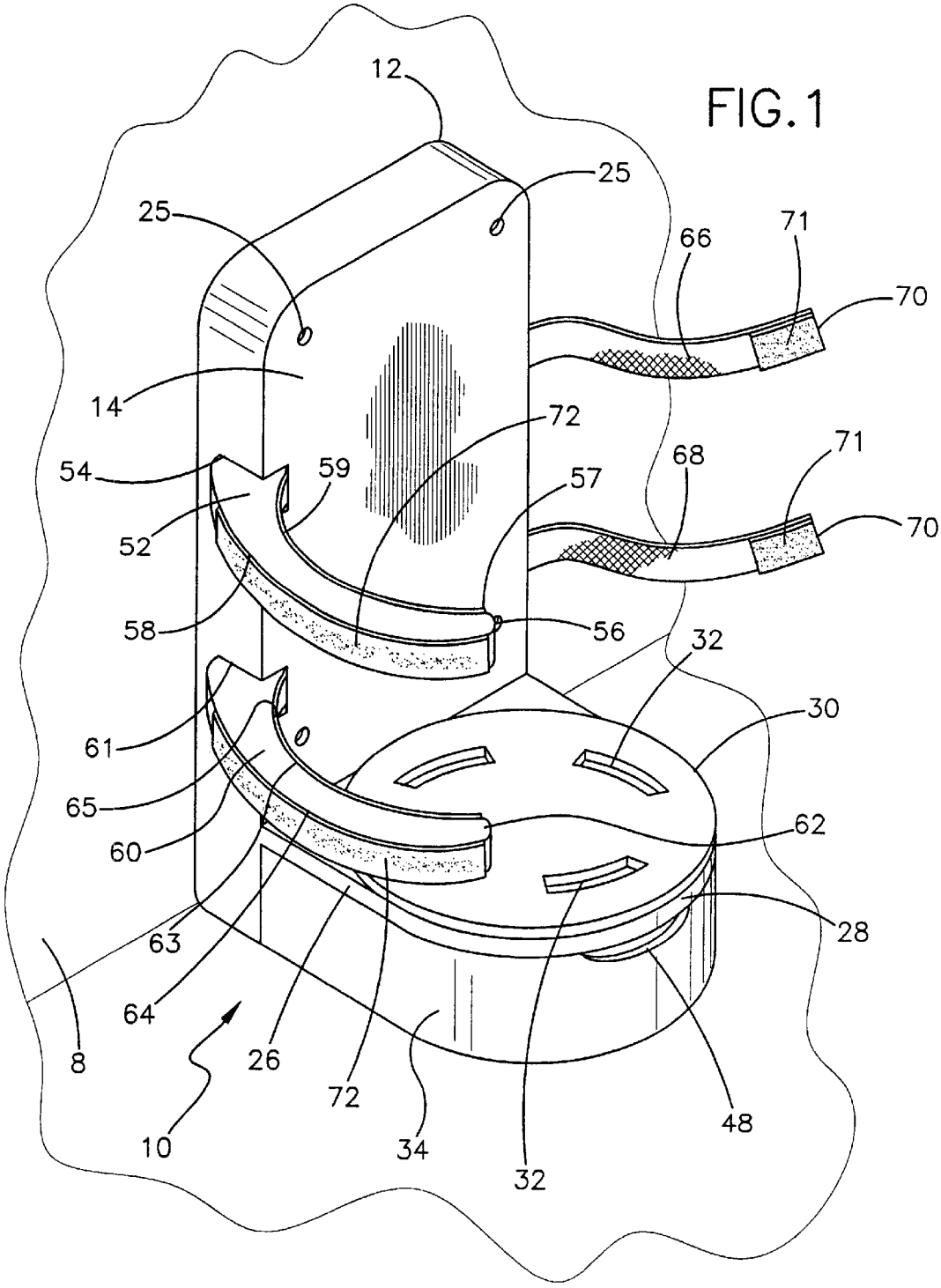
FIG. 1 is a schematic perspective view of a new jar opening device according to the present invention.
Figure 2:
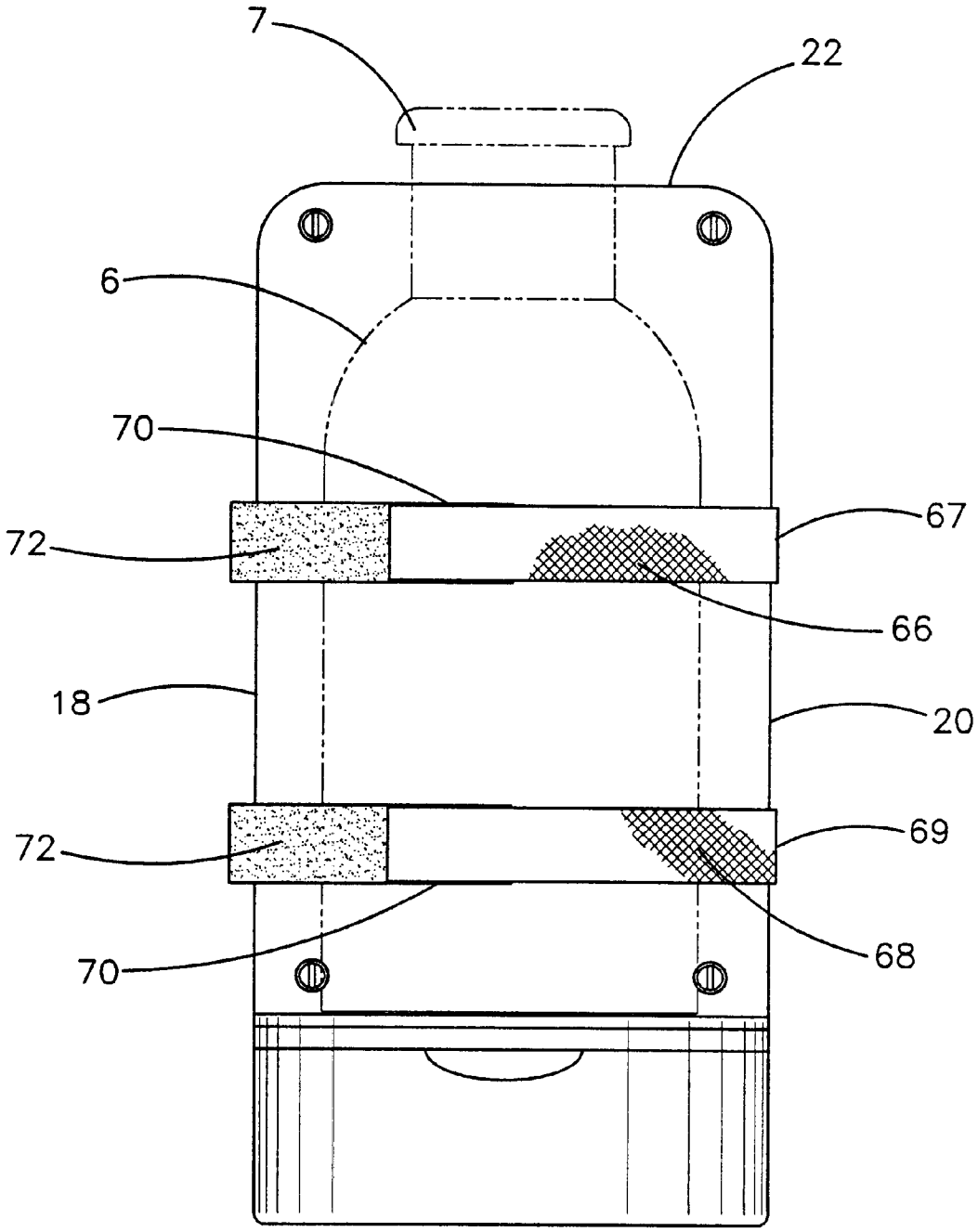
FIG. 2 is a schematic front view of the present invention.
Figure 3:
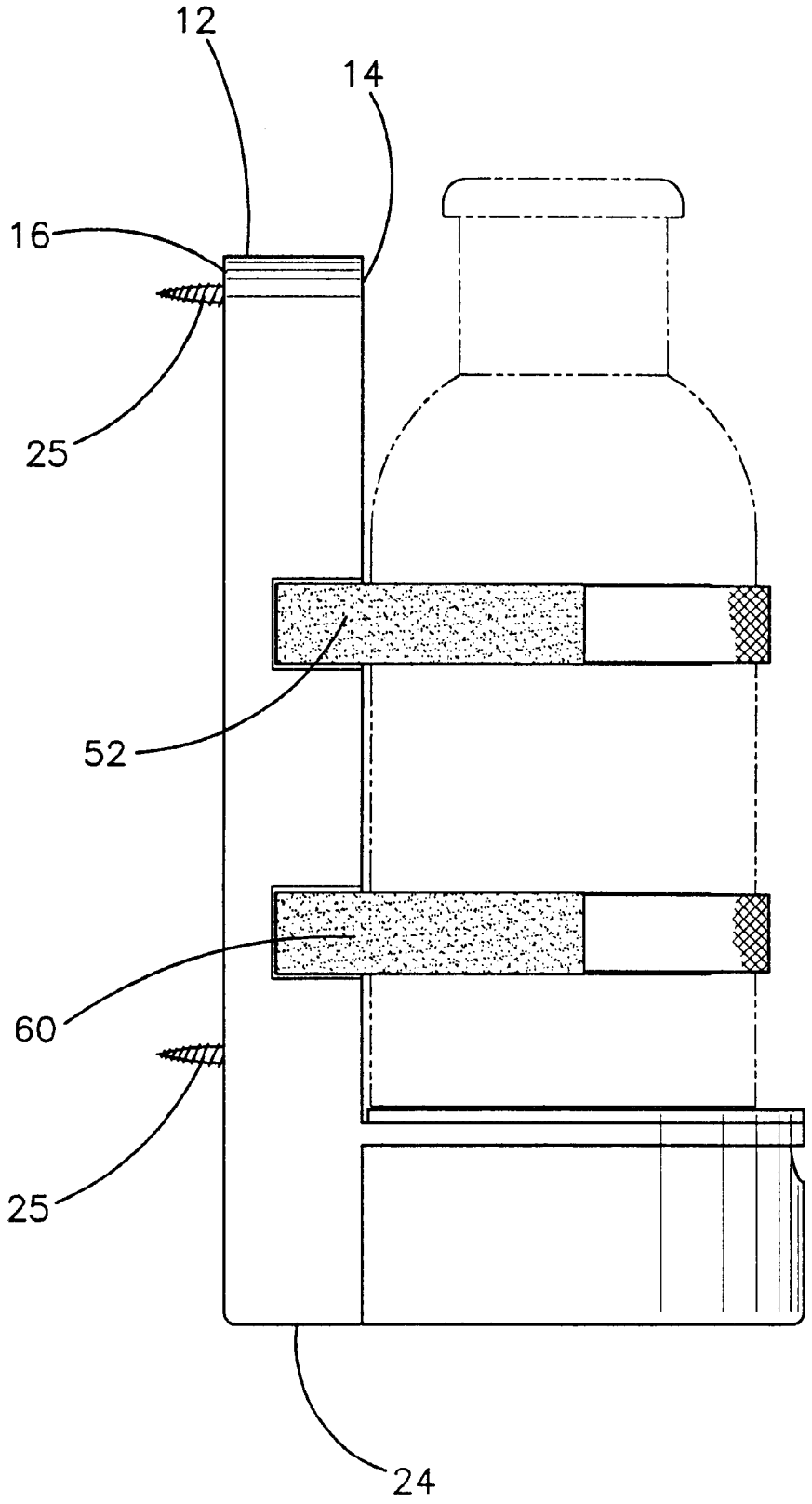
FIG. 3 is a schematic side view of the present invention.
Figure 4:
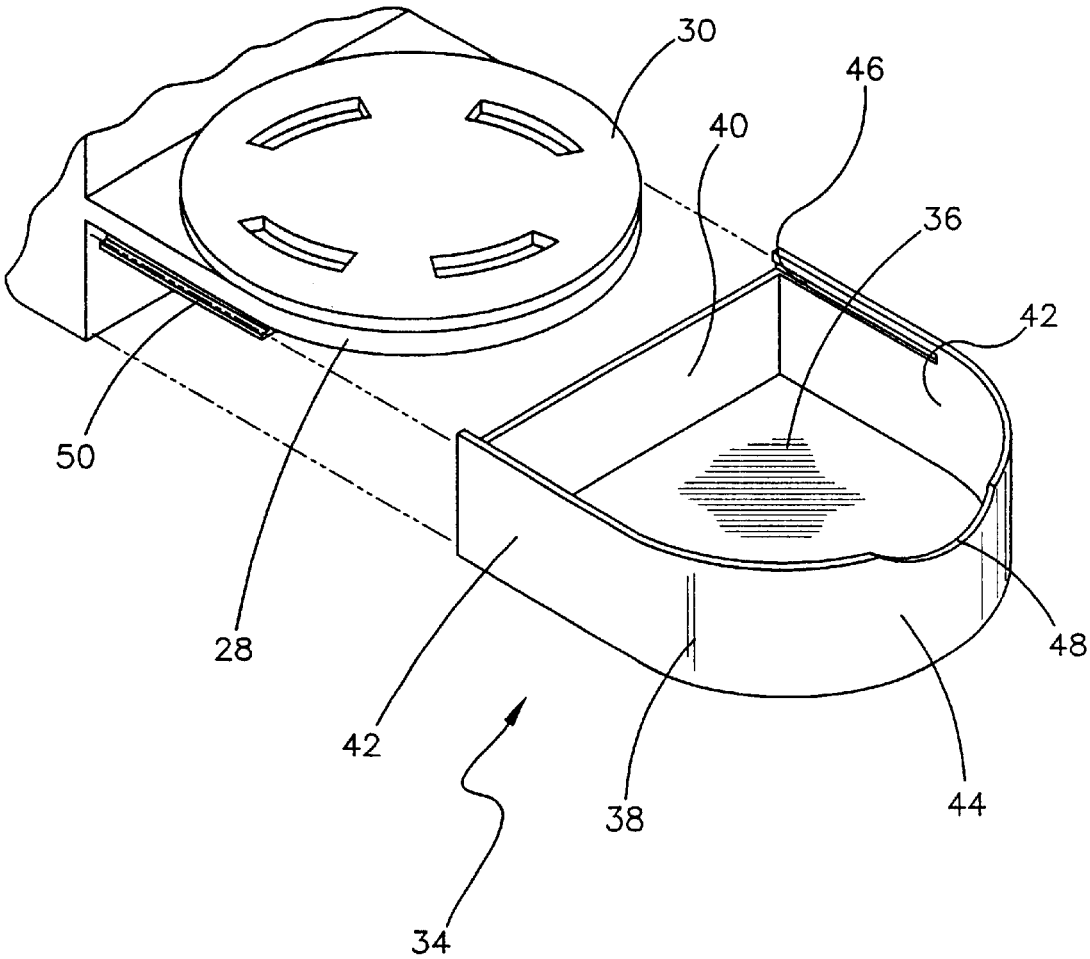
FIG. 4 is a schematic perspective view of the cup portion of the present invention.

With reference now to the drawings, and in particular to FIGS. 1 through 4 thereof, a new jar opening device embodying the principles and concepts of the present invention and generally designated by the reference numeral 10 will be described.

As best illustrated in FIGS. 1 through 4, the jar opening device 10 generally comprises a generally vertical wall 12 having a front surface 14 and a back surface 16. The vertical wall 12 has a first side edge 18, a second side edge 20, a top edge 22 and a bottom edge 24. Each of a plurality of securing members 25 extends through the vertical wall 12 and into a counter wall 8 for securing the vertical wall 12 to the counter wall 8. The vertical wall 12 generally has a height between 8 inches and 12 inches.

A plate 26 is integrally coupled to and extends outwardly from the front surface 14 of the vertical wall 12. The plate 26 is orientated generally horizontal. The plate 26 has an arcuate outer edge 28. The plate 26 is positioned nearer the bottom edge 24 than the top edge 22 of the vertical wall 12.

An elastomeric disc 30 is positioned on and securely coupled to a top surface of the plate 26. A plurality of holes 32 extends through the elastomeric disc 30 and the plate 26.

A cup portion 34 has a base wall 36 and a peripheral wall 38 integrally coupled to and extending upwardly from the base wall 36. The base wall 36 has a size and shape substantially equal to the plate 26 such that the peripheral wall 38 includes a back wall 40, a pair of side walls 42 and a front wall 44. The front wall 44 has an arcuate indentation 48 therein. Each of the side walls 42 has one of a pair of elongated slots 46 therein.

Each of a pair of bracket members 50 is securely coupled to a bottom surface of the plate 28. Each of the bracket members 50 comprises a flange positioned to releasably engage one of the slots 46 when the cup portion 34 is movably positioned below the plate 28.

A first arm 52 is elongated and has first end 54 and second end 56. The first arm 52 is arcuate and has an inner surface 57 and an outer surface 58. The first end 54 of the first arm is pivotally coupled to the first side edge 18 of the vertical wall 12 and is movable in a horizontal plane. The inner surface 57 of the first arm 52 is positioned adjacent to the front surface 14. The first arm is positioned generally between the top edge 22 and the plate 28. The inner surface 57 is substantially covered with an elastomeric coating 59.

A second arm 60 is elongated and has first end 61 and second end 62. The second arm 60 is arcuate and has an inner surface 63 and an outer surface 64. The first end 61 of the second arm 60 is pivotally coupled to the first side edge 18 of the vertical wall 12 and is movable in a horizontal plane. The inner surface 63 of the second arm 60 is positioned adjacent to the front surface 14. The second arm 60 is positioned generally between the first arm 52 and the plate 28. The inner surface 63 of the second arm 60 is substantially covered with an elastomeric coating 65. The first 52 and second 60 arms are each comprised of a substantially rigid material.

A first strap 66 has a first end 67 securely coupled to the second side edge 20 and positioned generally between the top edge 22 and the plate 28.

A second strap 68 has a first end 69 securely coupled to the second side edge 20 and positioned generally between the first strap 66 and the plate 28.

A pair of fasteners 70 removably fastens the first strap to the first arm and the second strap to the second arm. Each of the fasteners 70 comprises a hook portion 71 and a loop portion 72. Each of the loop portions 72 is securely coupled to and generally covers the outer surface 58, 64 of the first 52 and second 60 arms. Each of hook portions 71 is securely coupled to an inner surface one of the first 66 and second 68 straps and positioned generally adjacent to a second end 70 of the first 66 and second 68 straps.

In use, a jar 6 is positioned on the disc 30. The arms 52, 60 are abutted against the jar 6 and the straps 66, 68 secured to the arms 52, 60 so that the device 10 tightly holds the jar 6. Once secured, removing the cap 7 with one hand or two hands if needed can open the jar 6. The cup portion 34 will catch anything spilled from the jar 6 and can then be removed and cleaned.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jar opening assisting device for holding a jar such that a cover of said jar may be removed, said device being securable to a counter wall, said device comprising:

a generally vertical wall having a front surface and a back surface, said vertical wall having a first side edge, a second side edge, a top edge and a bottom edge, each of a plurality of securing members extending through said vertical wall and into the counter wall for securing the vertical wall to said counter wall;

a plate being integrally coupled to and extending outwardly from said front surface of said vertical wall, said plate being orientated generally horizontal, said plate being positioned nearer said bottom edge than said top edge of said vertical wall;

a first arm being elongated and having first end and second end, said first end of said first arm being pivotally coupled to said first side edge of said vertical wall and being movable in a horizontal plane, said first arm being positioned generally between said top edge and said plate;

a first strap having a first end securely coupled to said second side edge and positioned generally between said top edge and said plate; and a fastener removably fastens said first strap to said first arm.

2. The jar opening assisting device as in claim 1, wherein said vertical wall generally has a height between 8 inches and 12 inches.

3. The jar opening assisting device as in claim 1, further including:

an elastomeric disc being positioned on and securely coupled to a top surface of said plate.

4. The jar opening assisting device as in claim 3, further including:

said plate having an arcuate outer edge, a plurality of holes extending through said elastomeric disc and said plate; and a cup portion having a base wall and a peripheral wall integrally coupled to and extending upwardly from said base wall, said base wall having a size and shape substantially equal to said plate such that said peripheral wall includes a back wall, a pair of side walls and a front wall, said front wall having an arcuate indentation therein.

5. The jar opening assisting device as in claim 1, further including:

said plate having an arcuate outer edge, a plurality of holes extending through plate; and a cup portion having a base wall and a peripheral wall integrally coupled to and extending upwardly from said base wall, said base wall having a size and shape substantially equal to said plate such that said peripheral wall includes a back wall, a pair of side walls and a front wall, said front wall having an arcuate indentation therein.

6. The jar opening assisting device as in claim 5, further including:

each of said side walls having one of a pair of elongated slots therein; and a pair of bracket members being securely coupled to a bottom surface of said plate, each of said bracket members comprising a flange positioned to releasably engage one of said slots when said cup portion is movably positioned below said plate.

7. The jar opening assisting device as in claim 5, wherein said first arm is arcuate and has an inner surface and an outer surface, said inner surface of said first arm being positioned adjacent to said front surface.

8. The jar opening assisting device as in claim 7, wherein said inner surface being substantially covered with an elastomeric coating.

9. The jar opening assisting device as in claim 7, further including:

a second arm being elongated and having first end and second end, said second arm being arcuate and having an inner surface and an outer surface, said first end of said second arm being pivotally coupled to said first side edge of said vertical wall and being movable in a horizontal plane, said inner surface of said second arm being positioned adjacent to said front surface, said second arm being positioned generally between said first arm and said plate, said first and second arms comprising a substantially rigid material;

a second strap having a first end securely coupled to said second side edge and positioned generally between said first strap and said plate; and a fastener removably fastens said first strap to said first arm.

10. The jar opening assisting device as in claim 9, wherein each of said fasteners comprising a hook portion and a loop portion, each of said loop portions being securely coupled to and generally covering said outer surface of said first and second arms, each of hook portions being securely coupled to an inner surface of one of said first and second straps and positioned generally adjacent to a second end of said first and second straps.

11. A jar opening assisting device for holding a jar such that a cover of said jar may be removed, said device being securable to a counter wall, said device comprising:

a generally vertical wall having a front surface and a back surface, said vertical wall having a first side edge, a second side edge, a top edge and a bottom edge, each of a plurality of securing members extending through said vertical wall and into the counter wall for securing the vertical wall to said counter wall, said vertical wall generally having a height between 8 inches and 12 inches;

a plate being integrally coupled to and extending outwardly from said front surface of said vertical wall, said plate being orientated generally horizontal, said plate having an arcuate outer edge, said plate being positioned nearer said bottom edge than said top edge of said vertical wall;

an elastomeric disc being positioned on and securely coupled to a top surface of said plate, a plurality of holes extending through said elastomeric disc and said plate;

a cup portion having a base wall and a peripheral wall integrally coupled to and extending upwardly from said base wall, said base wall having a size and shape substantially equal to said plate such that said peripheral wall includes a back wall, a pair of side walls and a front wall, said front wall having an arcuate indentation therein, each of said side walls having one of a pair of elongated slots therein;

a pair of bracket members being securely coupled to a bottom surface of said plate, each of said bracket members comprising a flange positioned to releasably engage one of said slots when said cup portion is movably positioned below said plate;

a first arm being elongated and having first end and second end, said first arm being arcuate and having an inner surface and an outer surface, said first end of said first arm being pivotally coupled to said first side edge of said vertical wall and being movable in a horizontal plane, said inner surface of said first arm being positioned adjacent to said front surface, said first arm being positioned generally between said top edge and said plate, said inner surface being substantially covered with an elastomeric coating;

a second arm being elongated and having first end and second end, said second arm being arcuate and having an inner surface and an outer surface, said first end of said second arm being pivotally coupled to said first side edge of said vertical wall and being movable in a horizontal plane, said inner surface of said second arm being positioned adjacent to said front surface, said second arm being positioned generally between said first arm and said plate, said inner surface of said second arm being substantially covered with an elastomeric coating, said first and second arms comprising a substantially rigid material;

a first strap having a first end securely coupled to said second side edge and positioned generally between said top edge and said plate;

a second strap having a first end securely coupled to said second side edge and positioned generally between said first strap and said plate;

a pair of fasteners removably fasten said first strap to said first arm and said second strap to said second arm, each of said fasteners comprising a hook portion and a loop portion, each of said loop portions being securely coupled to and generally covering said outer surface of said first and second arms, each of hook portions being securely coupled to an inner surface of one of said first and second straps and positioned generally adjacent to a second end of said first and second straps.

* * * * *